United States Patent [19]

Furman

[11] Patent Number: 4,799,590

[45] Date of Patent: Jan. 24, 1989

[54] PACKAGE AND METHOD OF PACKAGING

[76] Inventor: Theodore J. Furman, 1935 Wenonah Ave., Berwyn, Ill. 60402

[21] Appl. No.: 9,763

[22] Filed: Feb. 2, 1987

[51] Int. Cl.[4] ..... B65D 83/04

[52] U.S. Cl. ..... 206/390; 53/142; 53/453; 53/478; 53/485; 53/591; 206/461; 206/469; 206/539; 206/820; 206/606

[58] Field of Search ..... 206/484, 538, 539, 820, 206/824, 390, 461, 469, 606; 53/478, 485, 453, 591, 142, 118, 430

[56] References Cited

U.S. PATENT DOCUMENTS

| | | | |
|---|---|---|---|
| 1,236,977 | 8/1917 | Pike . | |
| 2,132,144 | 10/1938 | Blum . | |
| 2,172,196 | 9/1939 | Flamm . | |
| 2,298,545 | 10/1942 | Waters . | |
| 2,858,224 | 10/1958 | Darrah . | |
| 2,908,383 | 10/1959 | Vogt | 206/461 |
| 2,917,216 | 12/1959 | Despres | 206/820 |
| 2,919,800 | 1/1960 | Jarund . | |
| 3,021,001 | 2/1962 | Donofrio | 220/23.8 |
| 3,603,453 | 9/1971 | Long et al. . | |
| 3,605,374 | 9/1971 | Mueller et al. | 229/2.5 R |
| 3,618,290 | 11/1971 | Delme | 53/142 |
| 3,659,706 | 5/1972 | Serrell | 206/539 |
| 3,737,029 | 6/1973 | Serrell et al. | 206/820 |
| 3,868,017 | 2/1975 | Carreth | 206/45.34 |
| 3,924,748 | 12/1979 | Braverman | 206/484 |
| 4,139,114 | 2/1979 | Long . | |
| 4,159,771 | 7/1979 | Komatsu et al. . | |
| 4,298,119 | 11/1981 | Murray . | |
| 4,320,846 | 3/1982 | Meyering et al. | 206/820 |
| 4,450,959 | 5/1984 | Sommer | 206/332 |

FOREIGN PATENT DOCUMENTS

| | | | |
|---|---|---|---|
| 2052426 | 1/1981 | United Kingdom | 206/461 |

*Primary Examiner*—Stephen Marcus

*Attorney, Agent, or Firm*—Wood, Dalton, Phillips, Mason & Rowe

[57] ABSTRACT

A package including a base portion formed of a semi-rigid material so as to be self-supporting. The base portion has a plurality of receptacles, each of which is individually separably joined to all adjacent receptacles by a connecting rim flange. The receptacles are disposed in a plurality of columns and rows in the base portion and the receptacles each have an opening defined by the connecting rim flange and extend from the connecting rim flange on one side thereof. The package also includes a cover portion joined to the base portion for entirely covering the receptacle openings including a plurality of cover segments disposed in a plurality of columns and rows. The cover segments each cooperate with the connecting rim flange of one of the receptacles and each are individually separably joined to all adjacent cover segments. The package is formed such that each of the receptacles and cover segments define a self-contained package unit where all of the self-contained package units together define a multi-unit package comprised of a plurality of the self-contained package units disposed in a plurality of rows and columns. The self-contained package units each are individually separably joined to all adjacent self-contained package units and the multi-unit package is disposed in a reverse-folded position. Further, the reverse-folded position is such that the receptacles extend interiorly thereof in confronting relation with the cover portion facing exteriorly thereof such that remote rows of the receptacles are in closely adjacent relation with the multi-unit package maintained in the reverse-folded position.

9 Claims, 2 Drawing Sheets

PACKAGE AND METHOD OF PACKAGING

FIELD OF THE INVENTION

The present invention relates to packaging and, more particularly, to a package and method of packaging.

BACKGROUND OF THE INVENTION

In recent years, the ever-increasing use of plastic materials has clearly proliferated in packaging concepts. This has occurred for many reasons including the fact that plastic materials have been relatively inexpensive, can be easily formed by injection molding, thermoforming, and other suitable methods into virtually any shape, accommodate safe and sterilized shipment of products from the manufacturer to the retailer and ultimately to the consumer, and are readily accepted as disposable by the consumer after use. While such plastic materials are widely recognized as highly desirable, those skilled in the art have only begun to appreciate their versatility.

In particular, despite utilization of plastic materials in modern packaging, it has remained to provide an entirely satisfactory multi-unit package that is formed of a plurality of self-contained package units. Such a package would be extremely useful not only to the consumer but also to the vendors of a multitude of products that are usually used in unit doses such as pharmaceuticals or in ordinary servings such as dairy and non-dairy creamers, jellies and other food products. Still further, a multi-unit package would be compact and attractive for the consumer to maintain in the home.

With a package of this type, a pharmacist could dispense pharmaceuticals to be taken by elderly persons in a strict regimen. The self-contained package units could then each contain either a single pharmaceutical or, if desired, multiple pharmaceuticals to be taken together at a given time after which another self-contained package unit could be separated from the multi-unit package at the next given time for taking such pharmaceuticals. In this manner, it would be possible to eliminate a major source of confusion in elderly persons.

While the benefit of such a package is manifest in the field of pharmaceuticals, it could apply to any person required to take individual units of medicine over a period of time. The one-by-one removal of the self-contained package units from the overall multi-unit package would give the person an indication of the stage of completion of the pharmaceutical regimen by merely glancing at the multi-unit package to determine the approximate number of self-contained package units remaining to be taken. Moreover, due to the attractiveness of the multi-unit package, the pharmaceuticals could be left in a prominent position in the kitchen or bathroom as a ready reminder to take the pharmaceuticals as prescribed.

In other fields, a multi-unit package would be no less desirable. Such a package could, for instance, be utilized to make available dairy and non-dairy creamers, jelly and the like either in restaurants or in the home. In the latter case, the quantity of the food product could be accurately controlled for dieting persons.

Once again, the multi-unit package would be sufficiently attractive to be prominently displayed in the home or restaurant. This, again, would lead to the overall desirability of such a packaging concept which has heretofore not been available to the consuming public. Additionally, a multi-unit package is certainly capable of utilization in numerous applications that have not been mentioned.

The present invention is directed to overcoming the above-stated problems and accomplishing the stated objects by providing a unique package and method of packaging.

SUMMARY OF THE INVENTION

Accordingly, the present invention is directed to a package having a base portion formed of a semi-rigid material so as to be self-supporting. The base portion has a plurality of receptacles each of which is individually separably joined to all adjacent receptacles by a connecting rim flange. With this arrangement, the receptacles each have an opening defined by the connecting rim flange and extend from the connecting rim flange on one side thereof.

Additionally, the package includes a cover portion joined to the base portion for entirely covering the receptacle openings. The cover portion includes a plurality of cover segments disposed in a plurality of columns and rows, and the receptacles are also disposed in a plurality of columns and rows in the base portion. Furthermore, the cover segments each cooperate with a connecting rim flange of one of the receptacles and each are individually separably joined to all adjacent cover segments.

Still further, each of the receptacles and cover segments define a self-contained package unit. The receptacles and cover segments together define a multi-unit package comprised of a plurality of the self-contained package units disposed in a plurality of columns and rows, as will be evident from the fact that the receptacles and cover segments are disposed in columns and rows. Moreover, each of the self-contained package units is individually separably joined to all adjacent self-contained package units.

Additionally, the multi-unit package is disposed in a reverse-folded position. The reverse-folded position is such that the receptacles extend interiorly thereof in confronting relation with the cover portion facing exteriorly thereof such that remote rows of the receptacles are in closely adjacent relation. With this configuration, means are provided for maintaining the multi-unit package in the reverse-folded position.

In the exemplary embodiment, the receptacles in the base portion are tapered so as to be generally wedge-shaped for disposing the multi-unit package in the reverse-folded position. Specifically, the receptacles in the base portion are defined by a pair of tapered side walls and a pair of parallel side walls joined by a bottom wall. The receptacles in each of the rows of the base portion are preferably disposed with the corresponding ones of the parallel side walls in common planes and the receptacles in each of the columns of the base portion are preferably disposed with corresponding ones of the tapered side walls in common planes. Still more specifically, the receptacles in each of the rows of the base portion are disposed with adjacent edges of the bottom walls in abutting relation. Furthermore, the receptacles in the base portion each are preferably formed with the bottom wall disposed relative to the connecting rim flange so as to be in parallel planes and the bottom wall and the opening defined by the connecting rim flange are generally rectangularly shaped.

In the preferred embodiment, the connecting rim flange is semi-separated entirely about each of the receptacles whereby each of the receptacles is individually separably joined to all adjacent receptacles. It is also advantageous for the cover portion to be semi-separated entirely about each of the cover segments whereby each of the cover segments is individually separably joined to all adjacent cover segments. With this arrangement, the connecting rim flange of each of the receptacles is preferably semi-separated in substantial conformity with the semi-separation of the corresponding ones of said cover segments of said cover portion.

Still further details of the preferred embodiment include the cover portion being formed of a flexible sheet material. This flexible sheet material is preferably sealed to the connecting rim flange of the base portion and includes a pair of parallel edges in proximity to remote rows of the receptacles with at least one of the edges extending beyond the corresponding one of the remote rows. When so constructed, the position maintaining means includes means for sealing the extending edge to the other of the parallel edges.

The present invention is also directed to a method of packaging that is adapted to provide a package that has the advantages that have been enumerated in detail hereinabove. The method includes the steps of providing a base portion having a plurality of receptacles with openings disposed in columns and rows so as to be individually separably joined to all adjacent receptacles by a connecting rim flange, covering the openings with a cover portion having a plurality of cover segments disposed in columns and rows so as to be individually separably joined to all adjacent cover segments by joining the cover portion to the connecting rim flange, and reverse-folding the base portion such that the receptacles extend interiorly thereof in confronting relation with the cover portion facing exteriorly thereof such that remote rows of the receptacles are in closely adjacent relation. In addition, the method includes the step of sealing one edge of the cover portion associated with one of the remote rows of receptacles to another edge of the cover portion associated with the other of the remote rows of receptacles to maintain the base portion in the reversefolded position.

Other objects, advantages and features of the present invention will become apparent from the following specification taken in conjunction with the accompanying drawings.

DETAILED DESCRIPTION OF THE PREFERRED EMBODIMENT

Figure 1:
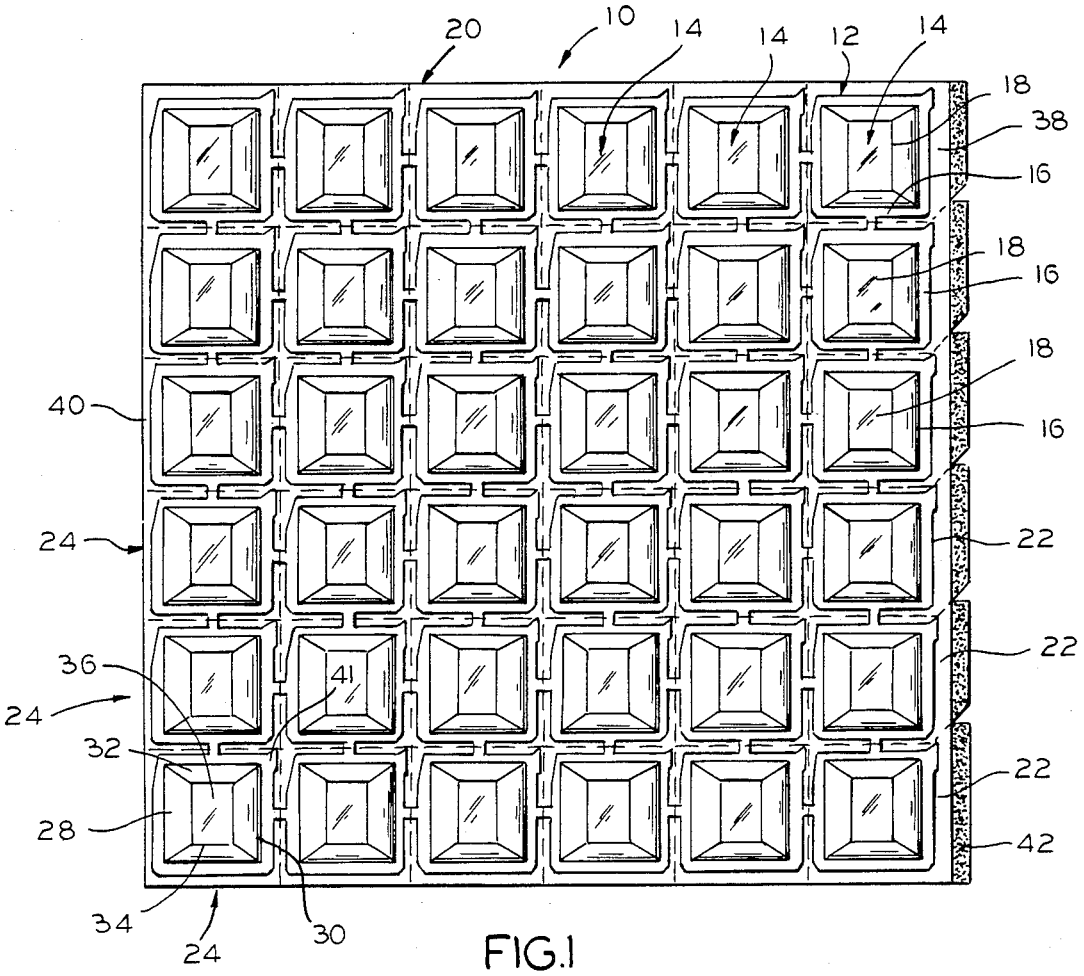
FIG. 1 is a bottom plan view of a package at an intermediate stage of formation according to the present invention.
Figure 2:
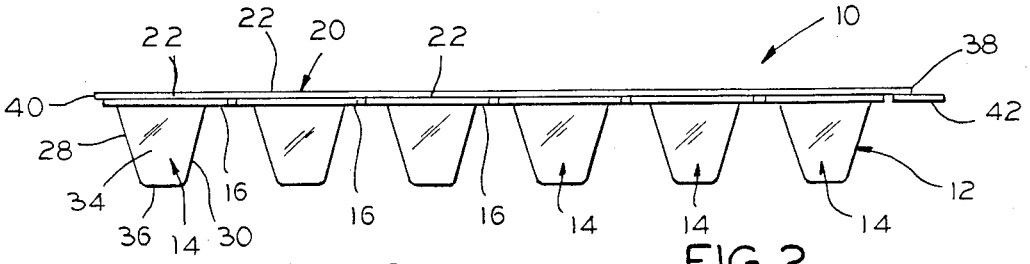
FIG. 2 is an end elevational view of the package as illustrated in FIG. 1.
Figure 3:
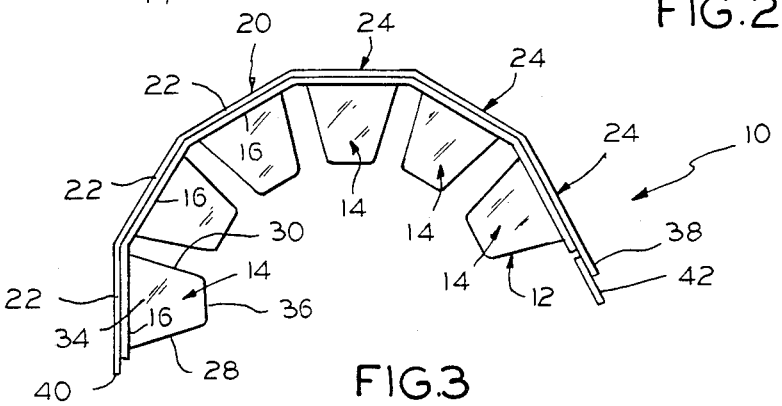
FIG. 3 is a view similar to FIG. 2 showing the package being reverse-folded.

Referring to the drawings, and first to FIGS. 1–3, 5 and 6, the reference numeral 10 designates generally a package in accordance with the present invention. The package 10 includes a base portion 12 formed of a semi-rigid material so as to be self-supporting and having a plurality of receptacles 14 each of which is individually separably joined to all adjacent receptacles 14 by a connecting rim flange 16. As shown, the receptacles 14 are disposed in a plurality of columns and rows in the base portion 12 (see, in particular, FIG. 1).

Figure 8:
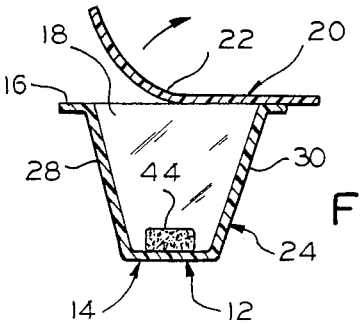
FIG. 8 is a cross-sectional view of a self-contained package unit.

As will be appreciated, the receptacles 14 each have an opening 18 defined by the connecting rim flange 16 and extending from the connecting rim flange 16 on one side thereof (see FIG. 8). A cover portion 20 is joined to the base portion 12 for entirely covering the receptacle openings 18, and the cover portion 20 includes a plurality of cover segments 22 disposed in a plurality of columns and rows. As will be appreciated, the cover segments 22 each cooperate with the connecting rim flange 16 of one of the receptacles 18 and the cover segments 22 each are individually separably joined to all adjacent cover segments.

Figure 7:
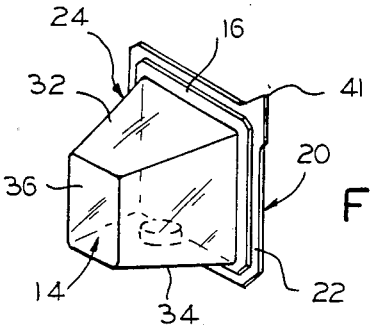
FIG. 7 is a perspective view of a self-contained package unit.

Referring to FIGS. 7 and 8, each of the receptacles 14 and cover segments 22 define a self-contained package unit designated 24. The receptacles 14 and cover segments 22 together define a multi-unit package 10 comprised of a plurality of the self-contained package units 24 disposed in a plurality of rows and columns, as will be clear from a consideration of FIG. 6. As shown, each of the self-contained package units 24 are individually separably joined to all adjacent self-contained package units 24.

The multi-unit package 10 is disposed in a reverse-folded position (compare FIGS. 2, 3, 5 and 6). It is reverse-folded such that the receptacles 14 extend interiorly thereof in confronting relation with the cover portion 20 facing exteriorly thereof such that remote rows of the receptacles 14 are in closely adjacent relation as at 26 (see FIGS. 5 and 6). With this arrangement, means are provided for maintaining the multi-unit package 10 in the reversefolded position, as will be described in detail hereinafter.

As will be appreciated from FIGS. 1–3 and 5–9, the receptacles 14 in the base portion 12 are tapered so as to be generally wedge-shaped for disposing the multi-unit package 10 in the reverse-folded position. More specifically, the receptacles 14 in the base portion 12 are defined by a pair of tapered side walls 28 and 30 and a pair of parallel side walls 32 and 34 joined by a bottom wall 36. Still more particularly, the receptacles 14 in the base portion 12 are disposed in each of the rows with corresponding ones of the parallel side walls 32 and 34 in common planes and are disposed in each of the columns with corresponding ones of the tapered side walls 28 and 30 in common planes.

Also as shown, the receptacles 14 in the base portion 12 are disposed in each of the rows with adjacent edges of the bottom walls 36 in abutting relation. It will also be appreciated that receptacles 14 in the base portion 12 each are formed with the bottom wall 36 disposed relative to the connecting rim flange 16 so as to be in parallel planes (see FIG. 8, in particular). Preferably, the receptacles 14 in the base portion 12 each are also formed with the bottom wall 36 and the opening 18 defined by the connecting rim flange 16 generally rectangularly shaped.

Figure 4:
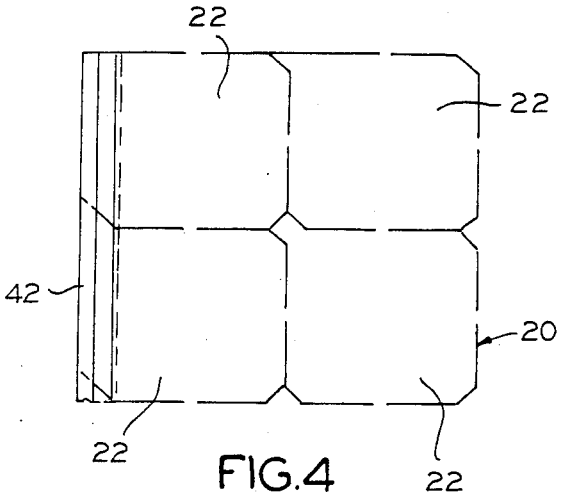
FIG. 4 is a schematic representation of the semiseparation of the self-contained package units.
Figure 5:
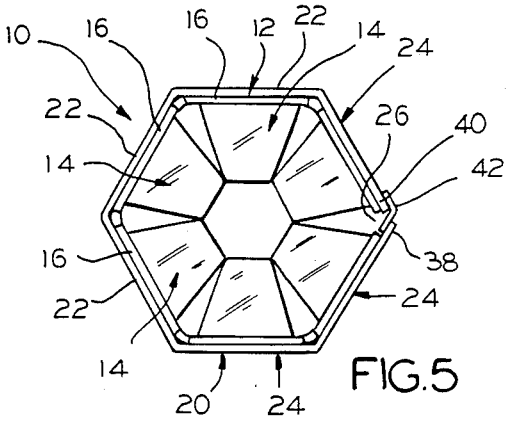
FIG. 5 is a top plan view of a completed package formed in accordance with the present invention.
Figure 6:
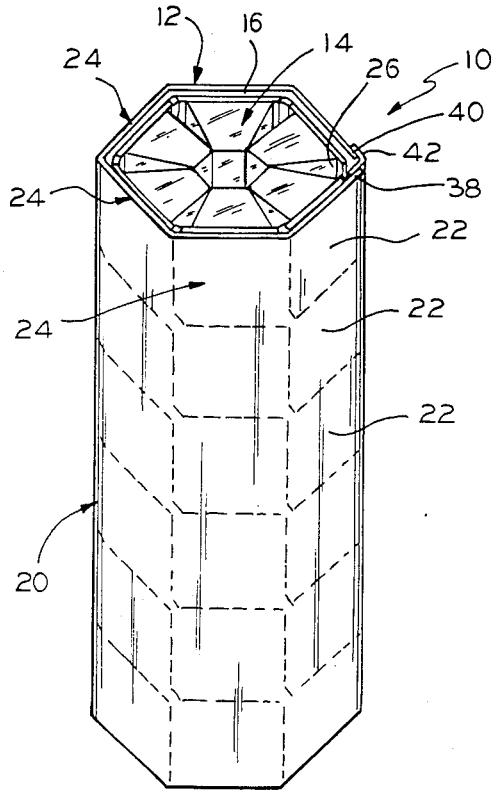
FIG. 6 is a perspective view of a completed package formed in accordance with the present invention.

As best shown in FIGS. 1, 4 and 7, the connecting rim flange 16 is semi-separated entirely about each of the receptacles 14 whereby each of the receptacles 14 is individually separably joined to all adjacent receptacles 14. It will also be appreciated by referring to the drawings that the cover portion 20 is similarly semi-separated entirely about each of the cover segments 22 whereby each of the cover segments 22 is individually separably joined to all adjacent cover segments 22. In the preferred embodiment, the connecting rim flange 16 of each of the receptacles 14 is semi-separated in substantial conformity with the semi-separation of the corresponding ones of the cover segments 22 of the cover portion 20.

Referring specifically to FIGS. 1–3, 5 and 6, the cover portion 20 includes a pair of parallel edges 38 and 40 in proximity to remote rows of the receptacle 14. The cover portion is preferably formed of a flexible sheet material which is sealed to the connecting rim flange 16 of the base portion 12 and at least one of the edges 38 advantageously extends beyond the corresponding one of the remote rows. With this arrangement, the position maintaining means includes means for sealing the extending edge 38 to the other of the parallel edges 40.

In a preferred embodiment, the base portion 12 can be formed in a number of ways, for instance, it can be injection molded, thermoformed, or can be formed utilizing any other method suitable for the chosen contents of the multiunit package 10. Materials such as polystyrene, styrene, and other materials suitable for the weight of the contents can be utilized. Additionally, the base portion 12 can be formed with the connecting rim flange 16 semi-separated or the connecting rim flange 16 can be formed solid and die-cut along with the cover portion 20 after sealing.

In any event, the connecting rim flange preferably includes a corner tab 41 to aid in separating a self-contained package unit 24 from the remainder of the multi-unit package 10. It may be also formed with multiple points of attachment between the connecting rim flange 16 of one of the self-contained package units 24 and all adjacent self-contained package units 24. Preferably, the connecting rim flange 16 is provided with a minimum of three points of attachment for the top and bottom rows of receptacles 14 and a maximum of six points of attachment for the intermediate rows of receptacles 14.

With regard to filling the receptacles 14, it will be appreciated that any method may be utilized which is suitable for the contents. It will also be appreciated that the cover portion 20 may be sealed to the base portion 12 by any of a number of conventional methods including heat sealing, sealing with a pressure sensitive adhesive, and other methods suitable for sealing the selected material. Furthermore, the connecting rim flange 16 and cover portion 20 may be semi-separated using die cut or laser cut with templates or other techniques known in the art.

As previously suggested, the multi-unit package 10 can be disposed in a reverse-folded position utilizing any method suitable for the contents. It will also be appreciated that the multi-unit package 10 can be maintained in the reverse-folded position by any suitable method including but not limited to the utilization of a pressure-sensitive adhesive strip 42, e.g., disposed along the edge 38 extending beyond the corresponding one of the remote rows of receptacles 14 which strip 42 can be utilized to adhere the edge 38 to the other of the pair of parallel edges 40. Of course, any other conventional means for maintaining the multi-unit package 10 in the reverse-folded position can be utilized as well.

With regard to the material utilized for the cover portion 22, a wide variety of materials is clearly available. This includes materials such as aluminum foil, polyolefin laminates, mylar, polyester, aluminum foil laminates, and other materials suitable for the selected contents and sealing method. In this connection, the versatility of the invention can be more fully appreciated.

The present invention is also directed to a method of packaging which includes the step of providing a base portion having a plurality of receptacles with openings disposed in columns and rows so as to be individually separably joined to all adjacent receptacles by a connecting rim flange. The openings are then covered wit: a cover portion having a plurality of cover segments disposed in columns and rows so as to be individually separably joined to all adjacent cover segments by joining the cover portion to the connecting rim flange, after which the method also includes the step of reverse-folding the base portion since the receptacles extend interiorly thereof in confronting relation with the cover portion facing exteriorly thereof, such that remote rows of the receptacles are in closely adjacent relation. Thereafter, one edge of the cover portion associated with one of the remote rows of receptacles is sealed to another edge of the cover portion associated with the other of the remote rows of receptacles to maintain the base portion in the reverse-folded position.

Figure 9:
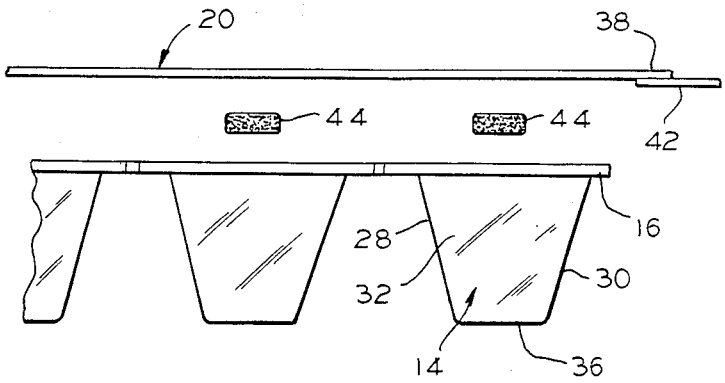
FIG. 9 is a partial schematic representation of a method in accordance with the present invention.

With the method, the receptacles can be formed with points of attachment in any conventional fashion, after which the receptacles can be filled with the desired contents, such as the pills 44 illustrated in FIGS. 7–9. Then, the cover portion can be applied and sealed and the cover portion and, if desired, the connecting rim flange can be perforated or die cut simultaneously particularly where the base portion is initially formed as an integral solid member. Where this has been done, the multi-unit package is reverse-folded with the receptacles disposed on the inside and the cover portion on the outside after which the extension of the cover portion is adhesively secured to the opposite end.

While in the foregoing there has been set forth a preferred embodiment of the invention, it will be understood that the details herein given may be varied by those skilled in the art without departing from the spirit and scope of the appended claims.

I claim:

1. A package, comprising:

a base portion formed of a semi-rigid material so as to be self-supporting, said base portion having a plurality of receptacles each of which is individually separably joined to all adjacent receptacles by a connecting rim flange, said receptacles being disposed in a plurality of columns and rows in said base portion;

said receptacles each having an opening defined by said connecting rim flange and extending from said connecting rim flange on one side thereof;

a cover portion joined to said base portion for entirely covering said receptacle openings, said cover portion including a plurality of cover segments disposed in a plurality of columns and rows;

said cover segments each cooperating with said connecting rim flange of one of said receptacles, said cover segments each being individually separably joined to all adjacent cover segments;

each of said receptacles and cover segments defining a self-contained package unit, said receptacles and cover segments together defining a multi-unit package comprised of a plurality of said self-contained package units disposed in a plurality of rows and columns, each of said self-contained package units being individually separably joined to all adjacent self-contained package units;

said multi-unit package being disposed in a reverse-folded position such that said receptacles extend interiorly thereof in confronting relation with said cover portion facing exteriorly thereof such that remote rows of said receptacles are in closely adjacent relation;

each of said receptacles being tapered so as to be generally wedge-shaped for disposing said multi-unit package in said reverse-folded position, each of said receptacles being defined in part by a pair of tapered side walls joined by a bottom wall;

said receptacles in each of said columns being disposed with corresponding ones of said tapered side walls in common planes, said receptacles in adjacent ones of said columns being disposed with adjacent ones of said tapered side walls in planes intersecting substantially at the corresponding ones of said bottom walls and said bottom walls of adjacent ones of said receptacles being disposed in intersecting planes, said receptacles in each of said rows being disposed with adjacent edges of said bottom walls in abutting relation; and means integrally associated with said cover portion for maintaining said multi-unit package in said reverse folded position as said self-contained package units are removed one-by-one one row at a time from said multi-unit package.

2. The package as defined by claim 1 wherein said receptacles in each of said rows of said base portion are disposed with corresponding ones of said parallel side walls in common planes.

3. The package as defined by claim 1 wherein said receptacles in said base portion each are formed with said bottom wall disposed relative to said connecting rim flange to as to be in parallel planes.

4. The package as defined by claim 3 wherein said receptacles in said base portion each are formed with said bottom wall and said opening defined by said connecting rim flange generally rectangular in shape.

5. The package as defined by claim 1 wherein said connecting rim flange is semi-separated entirely about each of said receptacles whereby each of said receptacles is individually separably joined to all adjacent receptacles.

6. The package as defined by claim 5 wherein said cover portion is semi-separated entirely about each of said cover segments whereby each of said cover segments is individually separably joined to all adjacent cover segments.

7. The package as defined by claim 6 wherein said connecting rim flange of each of said receptacles is semi-separated in substantial conformity with the semi-separation of the corresponding one of said cover segments of said cover portion.

8. The package as defined by claim 1 wherein said cover portion includes a pair of parallel edges in proximity to remote rows of said receptacles, at least one of said edges extending beyond the corresponding one of said remote rows, said position maintaining means including means for sealing said extending edge to the other of said parallel edges.

9. The package as defined by claim 1 wherein said cover portion is formed of a flexible sheet material and is secured to said connecting rim flange of said base portion.

* * * * *